US006578557B1

(12) United States Patent
Messick

(10) Patent No.: US 6,578,557 B1
(45) Date of Patent: Jun. 17, 2003

(54) HISTOGRAM-BASED ENRICHMENT DELAY

(75) Inventor: Troy A. Messick, Whitmore Lake, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/310,555

(22) Filed: Dec. 5, 2002

(51) Int. Cl.[7] ..... F02M 5/00

(52) U.S. Cl. ..... 123/491; 701/113; 60/285; 123/676

(58) Field of Search ..... 123/491, 676; 60/284, 285; 701/113

(56) References Cited

U.S. PATENT DOCUMENTS 5,103,791 A * 4/1992 Tomisawa ..... 123/676
5,186,155 A * 2/1993 Miyashita et al. ..... 123/685
6,076,348 A * 6/2000 Falandino et al. ..... 60/276

* cited by examiner

*Primary Examiner*—Bibhu Mohanty
(74) *Attorney, Agent, or Firm*—Ralph E. Smith

(57) ABSTRACT

A method for regulation of an engine of a vehicle by manner of temperature control delays based on a target temperature of a component of the engine. Once enrichment has been triggered, enrichment is continued to ensure a temperature of the component is below its target for a specified time, thereby ensuring that the temperature of the component has not exceeded its target temperature for more than a certain percentage of its life.

3 Claims, 1 Drawing Sheet

HISTOGRAM-BASED ENRICHMENT DELAY

FIELD OF THE INVENTION

The present invention relates to a method for controlling an engine.

BACKGROUND INFORMATION

Current thermal enrichment delay/target algorithms delay enrichment without adequately ensuring that histogram-based catalyst and engine component temperature targets are met. It may be desirable to control temperatures based on the percentage of the component(s) life that it has spent above specific target temperatures.

SUMMARY OF THE INVENTION

It is an object of the present invention to provide a method of delaying temperature-based enrichment in order to maximize fuel economy and minimize emissions while still protecting engine components and emissions system within prescribed limits. The method according to the present invention provides temperature control delays based on target temperature. Once enrichment has been triggered, enrichment is continued to ensure the temperature of the component is below its target for a calculated time based on a specified percentage of time that the component is allowed to exceed it's specified temperature, thereby ensuring that the temperature of the component has not exceeded its target temperature for more than a certain percentage of its life.

DETAILED DESCRIPTION

Figure 1:
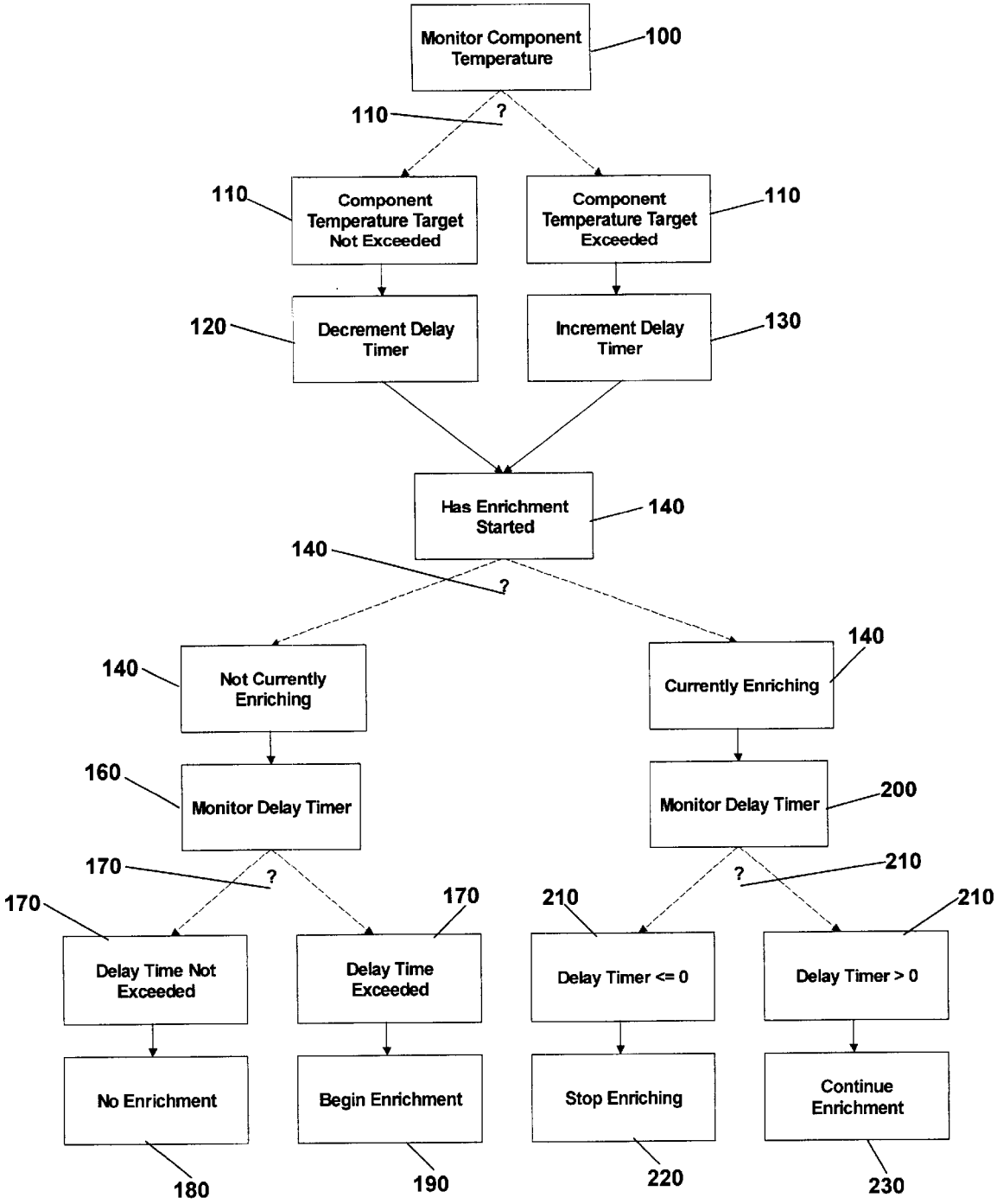
FIG. 1 shows an exemplary method according to the present invention.

FIG. 1 shows an exemplary method according to the present invention. The exemplary method provides for regulation of an engine component by manner of temperature control delays. In step 100, a component temperature is monitored. Next, in step 110 a determination is made whether the component temperature has exceeded a predetermined target temperature. Step 120 occurs if the component temperature has not exceeded the target temperature. In step 120, a delay timer is decremented. Step 130 occurs if the component temperature has exceeded the target temperature. In step 130, a delay timer is incremented. In step 120 and step 130, the delay timer is incremented or decremented depending on the state of the component temperature relative to the predetermined target temperature. The amount that the delay timer increments or decrements is dependent upon the predetermined percentage of time that the component is allowed to exceed the target temperature according to the following relationship:

$$\frac{IncrementAmount}{DecrementAmount} = \frac{100\% - SpecifiedPercentage}{SpecifiedPercentage}$$

For example, if the delay timer increment amount is set to 1, and the predetermined percentage is 5%, the decrement amount is:

$$\frac{1}{DecrementAmount} = \frac{100\% - 5\%}{5\%} = \frac{95\%}{5\%} = 19$$

$$DecrementAmount = \frac{1}{19}$$

In step 140, a determination is made as to whether enrichment has started. Step 160 occurs if enrichment has not started. In step 160, the delay timer is monitored in order to delay enrichment for a predetermined time. In step 170, the delay timer is compared to a predetermined enrichment delay time. If the delay timer has not exceeded the predetermined enrichment delay time, step 180 occurs. In step 180, the delay timer is continuously compared to the predetermined enrichment delay time as long as enrichment has not yet been initiated. If the delay timer has exceeded the predetermined delay time, step 190 occurs. In step 190, enrichment is started. Once initiated, it is expected that the enrichment will reduce the component temperature to below the predetermined target temperature. Step 200 occurs if enrichment has started. When enrichment has started the delay timer will begin to decrement. In step 200, the delay timer is monitored. In step 210, the delay timer is compared to zero. If the delay timer is less than or equal to zero, step 220 occurs. In step 220, enrichment is stopped. If the delay timer is greater than zero, step 230 occurs. In step 230, enrichment is allowed to continue and the monitoring of the delay timer also continues.

The relationship between the increment and decrement amounts for the delay timer assures that the histogram-based temperature targets for the component are not exceeded.

Continuing the above example, if the specified delay time were set equal to 10, it would take 10 execution loops before enrichment is triggered. Since the decrement rate is 1/19 of the increment rate, it enrichment would continue for 190 execution loops once triggered. This ensures that the component was only above the target temperature for $$\frac{10}{10+190} = \frac{10}{200} = 5\% \text{ of the time.}$$

In a further embodiment of the present invention, the method may be configured as a computer program that is stored on a memory. The computer program may be executed by a computer and contains program code for performing the method as described in reference to FIG. 1. The computer that executes the computer program may be situated in an engine control unit.

What is claimed is:

1. A method for regulation of an engine component temperature by manner of temperature control delays, comprising:

monitoring a temperature of a component of an engine;

one of incrementing and decrementing a delay timer based on the temperature of the component relative to a target temperature for the component and a predetermined percentage of time that the component is allowed to exceed the target temperature;

triggering enrichment of the component of the engine based on the delay timer;

controlling the temperature of the component based on a percentage of a time that the component has spent above the target temperature for the component; and continuing enrichment to ensure that the temperature of the component is below the target temperature for the component for an amount of time;

wherein multiple target temperatures and multiple enrichment triggers are used to control the temperature of the component in a histogram-type manner.

2. A computer program stored on a memory configured to be executed by a computer, the computer program comprising program code for regulation of an engine component temperature by manner of temperature control delays in accordance with a method including:

monitoring a temperature of a component of an engine;

one of incrementing and decrementing a delay timer based on the temperature of the component relative to a target temperature for the component and a predetermined percentage of time that the component is allowed to exceed the target temperature;

triggering enrichment of the component of the engine based on the delay timer;

controlling the temperature of the component based on a percentage of a time that the component has spent above the target temperature for the component; and continuing enrichment to ensure that the temperature of the component is below the target temperature for the component for an amount of time;

wherein multiple target temperatures and multiple enrichment triggers are used to control the temperature of the component in a histogram-type manner.

3. The computer program of claim 2, wherein the computer is situated in an engine control unit.

* * * * *